US005178192A

United States Patent [19]

Koch

[11] Patent Number: 5,178,192

[45] Date of Patent: Jan. 12, 1993

[54] HEDDLE TO SLIDE BAR ARRANGEMENT

[75] Inventor: Bernhard Koch, Horgenberg, Switzerland

[73] Assignee: Grob & Co. Aktiengesellschaft, Horgen, Switzerland

[21] Appl. No.: 734,737

[22] Filed: Jul. 23, 1991

[30] Foreign Application Priority Data

Jul. 24, 1990 [DE] Fed. Rep. of Germany ..... 4023498

[51] Int. Cl.[5] ..... D03C 9/06

[52] U.S. Cl. ..... 139/91; 139/93

[58] Field of Search ..... 139/91-93

[56] References Cited

U.S. PATENT DOCUMENTS 3,604,469 9/1971 Schneiter ..... 139/91
4,492,256 1/1985 Kramer ..... 139/92
4,790,357 12/1988 Kramer ..... 139/91
4,913,194 4/1990 Kramer ..... 139/91

FOREIGN PATENT DOCUMENTS 2041082 5/1971 Fed. Rep. of Germany ..... 139/91

*Primary Examiner*—Andrew M. Falik
*Attorney, Agent, or Firm*—Watson, Cole, Grindle & Watson

[57] ABSTRACT

A heddle shaft has only one heddle supporting member at the opposite ends of which side supports are provided to guide the heddle shaft in the weaving machine. The supporting member has a heddle slide bar and an auxiliary heddle holding element extending parallel to and spaced from the heddle slide bar. All heddles are held virtually without play at the heddle slide bar and are held with play at the auxiliary holding element, and the opposite free ends of the heddles are not firmly held.

10 Claims, 2 Drawing Sheets

HEDDLE TO SLIDE BAR ARRANGEMENT

RELATED APPLICATION

This application relates to U.S. Ser. No. 07/734,668 filed on even date herewith and entitled "Heddles," commonly owned herewith.

BACKGROUND OF THE INVENTION

This invention relates to a heddle frame for the oscillating movement of a plurality of heddles in a weaving machine, and more particularly to such heddle frame comprising only a single, elongated heddle supporting member having a slide bar extending parallel to the longitudinal axis of the member for holding the plurality of heddles at only one end section thereof.

Heddle frames in general use are in the form of a rectangular frame comprising an upper heddle supporting member and a lower heddle supporting member, and side supports connecting opposing ends of the supporting members together. For long heddle frames used in very wide weaving machines, so-called intermediate struts are provided as additional supporting elements at the center of the frame parallel to the side supports and function, in addition to the side supports, for maintaining the two supporting members parallel and at a fixed spacing from one another. Each of the supporting members has a heddle slide bar on which the heddles are lined up and engage with both their end hooks. Since the heddle frames are oscillated, the supporting members oscillate such that the distance between the two supporting members constantly changes during the weaving operation. Therefore, due to these oscillations, the heddles must be held with relatively much play on the heddle slide bars, since without such a play they would be damaged during the oscillating movement. And, because of the possible relative movement of the heddles on the heddle slide bars, the existing play causes damage to the slide bars in a relatively short period of time. It is apparent that at increasingly higher speeds of the weaving machines, the negative effects caused by the oscillations increase in proportion and the limits of permissible loads are quickly reached.

German published application 20 41 082 discloses a heddle shaft having only one supporting member, one end of the heddles being attached to such member. However, to prevent the heddles from pivoting, they are guided by their opposing free ends into a stationary guide and must therefore be relatively long. For such reason the are also susceptible to oscillations at higher speeds.

SUMMARY OF THE INVENTION

The aforementioned problems are solved by the present invention by the provision of a heddle shaft which allows for higher speeds of the weaving machine without the attending problems.

The heddle shaft according to the invention has only a single, elongated heddle supporting member with a slide bar extending parallel to the longitudinal axis of such member, for holding a plurality of heddles at only one single end section thereof. The supporting member has an auxiliary holding element for further holding the heddles at only such one end section of the heddles. The holding element lies at a fixed spacing from and parallel to the slide bar, and the slide bar and holding element together comprise only a two-point means for holding the heddles on the supporting member at the one end section of the heddles for the purpose of the oscillating movement.

The aforementioned problems experienced during use of known heddle shafts are eliminated by the invention in that the present heddle shaft avoids the need to maintain two heddle supporting members at a precise distance from one another, as before. Therefore, the requisite play between the two heddle slide bars and the heddles need not be taken into account, but rather the heddles can be lined up on the heddle slide bar with a minimum amount of play and only provided with a lateral mobility required during operation. Damage to the heddles is thereby avoided and wear of the heddle slide bar is significantly reduced. Since one heddle supporting member is dispensed with and, therefore, the oscillating mass is correspondingly reduced, the one existing supporting member can be designed significantly more rigid without the moving mass becoming as large as that for a heddle frame having two heddle supporting members. Besides the prevention of wear and the risk of damage to the heddles, the entire movement of the shed becomes significantly smoother with the heddle shaft of the invention.

The mounting of the heddles at their opposite ends in the known heddle frames is, according to the invention, replaced by a two-point mounting of the heddles at only one single end section thereof, so that the heddles cannot pivot. Preferably an auxiliary slide bar, on which the heddles are held with somewhat more play than on the first heddle slide bar, is arranged on the single heddle supporting member parallel to and at a fixed distance from the first heddle slide bar. In such manner, the possibility of the heddles moving sideways during operation is assured. Instead of an auxiliary bar, the heddle supporting member may have a groove for the reception of suitably designed heddle ends.

The heddle slide bar and the auxiliary slide bar for the groove can be arranged on the side surfaces of the supporting member, or at the upper and lower longitudinal edges thereof. To automatically draw-in the warp threads, it is expedient to arrange at least one of these slide bars at the side surface of the heddle supporting member. Moreover, the supporting member can be structured in the same manner as the heddle supporting member of a conventional heddle frame i.e., preferably of an extruded aluminum profile. As an even more advantageous construction, the supporting member can be formed as a hollow body of very thin sheet steel wall elements and shaped frame strips which may be welded together and which may include a core of rigid plastic foam material. Moreover, the supporting member may be of a fiber-reinforced plastic material which is even lighter and suitable for even higher speeds.

DETAILED DESCRIPTION OF THE INVENTION

Figure 1:
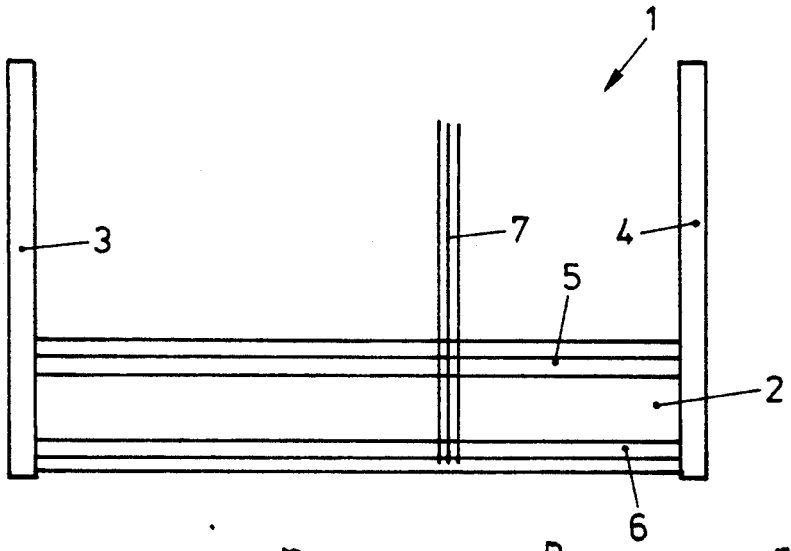
FIG. 1 is a front elevational view of a heddle shaft according to the invention, having only a single heddle supporting member.
Figure 2:
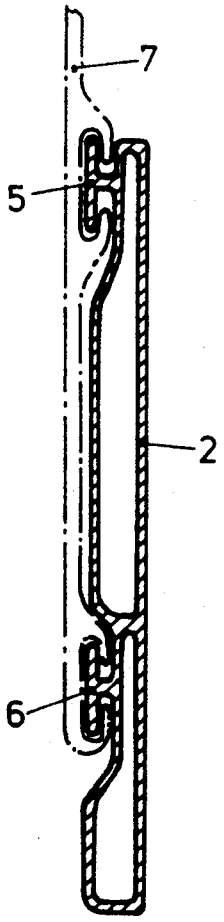
FIGS. 2, 3 and 4 are cross-sectional views of various shapes of heddle-supporting members of the invention, each having a heddle slide bar and an auxiliary heddle-holding element.

Turning now to the drawings wherein like reference characters refer to like and corresponding parts throughout the several views, a heddle frame of the invention is generally designated 1 in FIG. 1 and has only one single elongated heddle supporting member 2 and a pair of side guides 3 and 4 respectively at opposite ends of the supporting member, the ends serving to guide the heddle frame in the weaving machine. The supporting member is illustrated as located at the lower ends of side supports 3 and 4, although the supporting member can alternatively be located at the upper ends of the side supports.

Heddle supporting member 2 has a heddle slide bar 5 extending parallel to the longitudinal axis of the supporting member. The supporting member further has an auxiliary holding element or bar parallel to slide bar 5 and at a fixed distance therefrom. Slide bar 5 and bar 6 may be attached to one side of the supporting member or may be integrally formed and shaped therewith.

A plurality of heddles 7 are securely held at each lower end section thereof at supporting member 2 via complimentary male/female engaging portions on both the bars 5 and 6 and the heddle section 7. In this manner heddle slide bar 5 is held with practically no play and via auxiliary holding element 6 is held with play, so that heddles 7 can move somewhat in the longitudinal direction of the auxiliary holding element but are prevented from pivoting owing to the limitation of play at slide bar 5. The opposite free ends of heddles 7 are not securely held.

The attachment of heddles 7 to supporting member 2 is set forth in FIGS. 2 to 8 in which different variants of the attachments and designs of the supporting member are shown. According to FIG. 2, supporting member 2 is of an extruded aluminum profile with a molded heddle slide bar 5 at the upper end and an auxiliary holding element in the form of a slide bar 6 in the lower region. The bars arranged at one side surface of the supporting member enable the warp threads to be drawn-in automatically.

Figure 3:
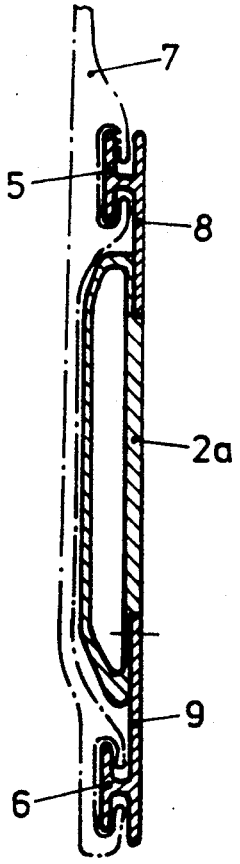

Supporting member **2*a* shown in FIG. 3 is assembled of an essentially flat, hollow pipe and strip-shaped bodies 8 and 9 attached to the flat pipe in some normal manner, with slide bar at the upper body and auxiliary bar 6** at the lower body.

Figure 4:
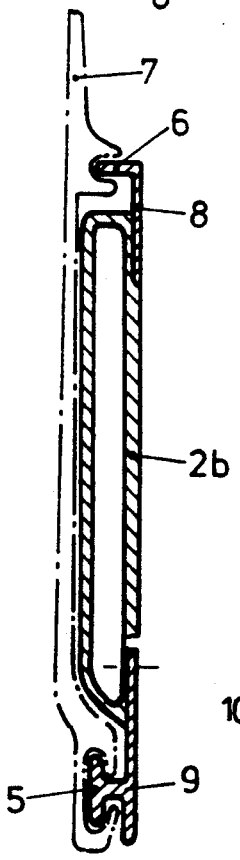

Supporting member **2*b* of FIG. 4 is also assembled in the same manner, with one difference that the heddle slide bar 5 is at the lower end of the supporting member, and auxiliary bar 6 at the upper end comprises only a horizontal leg at strip-shaped body 8**.

Figure 5:
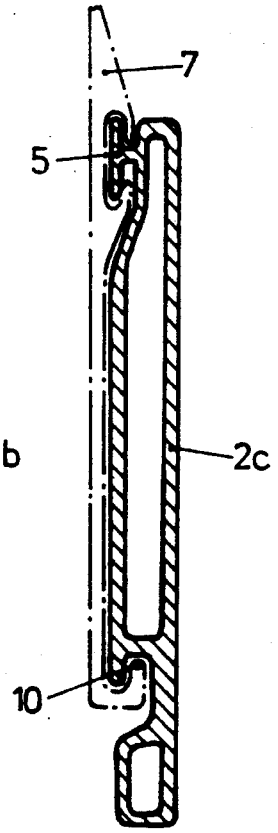
FIG. 5 is a cross-sectional view of a supporting member of the invention in which the auxiliary holding element is in the form of a groove.

In the embodiment according to FIG. 5, instead of an auxiliary bar 6 in the bottom region of supporting member **2*c*, a groove 10 is formed with which a hook end of heddle 7** engages at which there is play.

Figure 6:
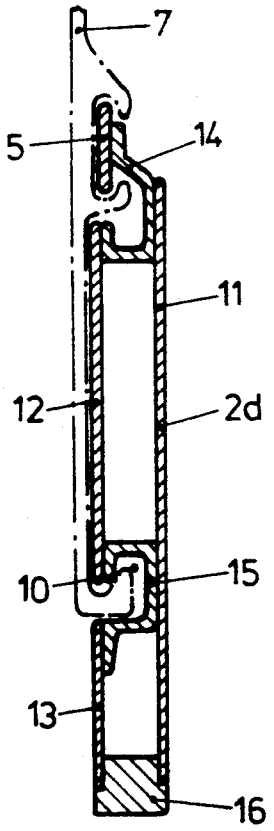
FIG. 6 is a cross-sectional view of a supporting member of the invention made of sheet steel assembled together as by welding.

Supporting member **2*d* of FIG. 6 likewise has a groove 10 which serves for the same purpose and in the same manner provided for supporting member 2*c*. Moreover, supporting member 2*d* is made of thin, flat sheet metal sections 11, 12, 13 and profile strips 14, 15, 16** interconnected as by laser beam welding to the metal sections.

The hollow space formed between 11, 12, 14 and 15, and the hollow space between 11, 13, 15 and 16 can each be filled with a core 23 of light, pressure-proof material such as a rigid plastic foam material or a rigid plastic honeycomb material.

Figure 7:
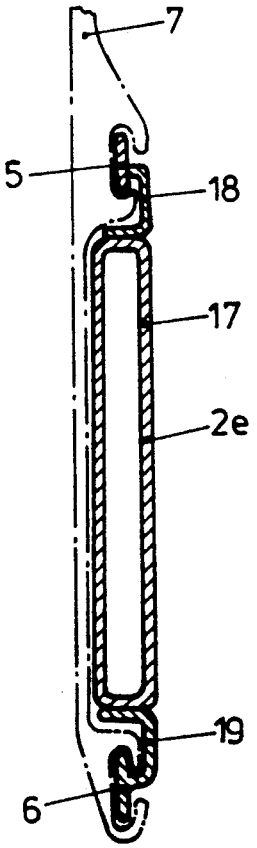
FIG. 7 is a cross-sectional view of a supporting member of the invention made of steel pipe.

Supporting member **2*e* of FIG. 7 comprises a flat steel hollow tube 17 with a profile strip 18 along its upper longitudinal edge, strip 18 having a heddle slide bar 5 formed thereon. Another profile strip 19 is connected to the flat steel tube along the lower longitudinal edge thereof, strip 19 having an auxiliary bar 6** formed thereon.

Figure 8:
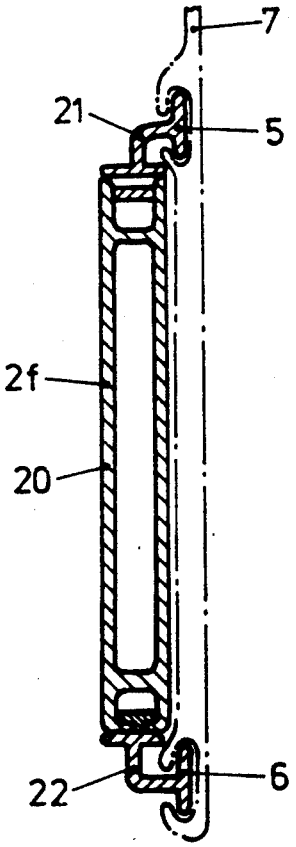
FIG. 8 is a cross-sectional view of a supporting member of the invention of a hollow plastic construction.

Supporting member **2*f* of FIG. 8 is of a fiber-reinforced plastic hollow profile 20 with bodies 21 and 22** designed as profile strips and attached along the upper and lower longitudinal edges, respectively.

It is apparent that besides the examples shown, still other embodiments of a supporting member are made possible according to the teachings of the invention. It is only important that in addition to the heddle slide bar, there is provided a second holding element for the heddles.

What is claimed is:

1. A heddle frame for the oscillating movement of a plurality of heddles in a weaving machine, said frame comprising only a single, elongated heddle supporting member having a slide bar extending parallel to the longitudinal axis of said member for holding the plurality of heddles at only one single end section thereof leaving the other end of said heddle free, said supporting member having an auxiliary holding bar lying at a fixed spacing from and parallel to said slide bar said heddle slide bar and auxiliary holding bar both including male/female means to engage with a complementary male/female engaging means on the heddle end section thereby defining, a two-point means for holding the heddles on said supporting member at said one end section of the heddles for the purpose of the oscillating movement.

2. The heddle frame according to claim 1, wherein said holding bar comprises an auxiliary slide bar.

3. The heddle frame according to claim 1, wherein said holding bar comprises a groove formed in said supporting member for the reception of hook ends provided on said heddles.

4. The heddle frame according to claim 1, wherein said supporting member is of an extruded aluminum shape.

5. The heddle frame according to claim 1, wherein said supporting member comprises a hollow steel tube of rectangular shape.

6. The heddle frame according to claim 1, wherein said supporting member comprises a hollow steel tube of oval shape.

7. The heddle frame according to claim 1, wherein said supporting member comprises a plurality of spaced, parallel frame strips, and thin, opposing and spaced side walls of sheet metal connected to said strips for forming said supporting member as a hollow construction.

8. The heddle frame according to claim 7, wherein said hollow supporting member is filled with a rigid plastic foam material.

9. The heddle frame according to claim 7, wherein said hollow supporting member is filled with a rigid honeycomb plastic material.

10. The heddle frame according to claim 1, wherein said supporting member is of fiber-reinforced plastic material of one of aramide fibers, glass fibers, carbon fibers, and a mixture of aramide, glass and carbon fibers.

* * * * *